US007908766B2

(12) United States Patent
Ahn et al.

(10) Patent No.: US 7,908,766 B2
(45) Date of Patent: Mar. 22, 2011

(54) CLOTHES DRYER

(75) Inventors: Seung-Phyo Ahn, Gyeongsangnam-Do (KR); Seung-Myun Baek, Gyeongsangnam-Do (KR); Jung-Wook Moon, Gyeongsangnam-Do (KR); Dae-Woong Kim, Gyeongsangnam-Do (KR); Byeong-Jo Ryoo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 615 days.

(21) Appl. No.: 11/596,408

(22) PCT Filed: Dec. 6, 2004

(86) PCT No.: PCT/KR2004/003189

§ 371 (c)(1),
(2), (4) Date: Nov. 14, 2006

(87) PCT Pub. No.: WO2006/062262

PCT Pub. Date: Jun. 15, 2006

(65) Prior Publication Data

US 2008/0034608 A1 Feb. 14, 2008

(51) Int. Cl.
*F26B 19/00* (2006.01)

(52) U.S. Cl. ..... 34/595; 34/134; 34/60; 34/602; 34/610; 8/159; 8/149.1; 68/19.2; 68/18 C; 68/20; 219/684; 219/400; 126/21 A; 210/212; 210/139; 165/118; 165/156

(58) Field of Classification Search ..... 34/595, 34/134, 60, 602, 610, 606, 210, 218; 165/118, 165/156; 8/159, 149.1; 126/21 A; 68/19.2, 18 C, 20; 219/684; 210/212, 139
See application file for complete search history.

(56) References Cited

U.S. PATENT DOCUMENTS

| | | | | | |
|---|---|---|---|---|---|
| 1,865,255 | A | * | 6/1932 | Jacocks | 165/118 |
| 1,964,890 | A | * | 7/1934 | Neeson | 165/96 |
| 2,237,257 | A | * | 4/1941 | Finnegan | 62/63 |
| 2,290,470 | A | * | 7/1942 | Hall | 159/4.1 |
| 2,310,680 | A | * | 2/1943 | Dinley | 34/74 |
| 2,328,256 | A | * | 8/1943 | Breckenridge | 210/212 |
| 2,389,433 | A | * | 11/1945 | Hough | 34/87 |
| 2,453,859 | A | * | 11/1948 | Pugh | 34/60 |
| 2,503,448 | A | * | 4/1950 | Morris | 432/105 |
| 2,617,203 | A | * | 11/1952 | Murray | 34/82 |

(Continued)

FOREIGN PATENT DOCUMENTS

DE 25 24 089 A1 12/1976

(Continued)

OTHER PUBLICATIONS

International Search Report dated May 31, 2005.

*Primary Examiner* — Stephen M. Gravini
(74) *Attorney, Agent, or Firm* — KED & Associates, LLP

(57) ABSTRACT

A clothes dryer is provided. In the dryer, air flowing into a drying container is provided with heat from heat pump. The clothes dryer comprises a cabinet, a drying container rotationally mounted in the cabinet, a motor providing the container with rotational force, a first air path connected to a side of the container, a second air path connected to another side of the container and to the outside of the cabinet, and a first heat exchanging member and a second heat exchanging member in the first air path. A damper may be additionally included in the second air path.

5 Claims, 7 Drawing Sheets

U.S. PATENT DOCUMENTS

| | | | | | |
|---|---|---|---|---|---|
| 2,673,727 | A | * | 3/1954 | Smith | 432/107 |
| 2,686,978 | A | * | 8/1954 | Herbster | 34/608 |
| 2,688,806 | A | * | 9/1954 | Long | 34/75 |
| 2,742,708 | A | * | 4/1956 | McCormick | 34/76 |
| 2,743,533 | A | * | 5/1956 | Smith | 34/547 |
| 2,752,694 | A | * | 7/1956 | McCormick | 34/60 |
| 2,783,549 | A | * | 3/1957 | Young | 34/83 |
| 2,792,640 | A | * | 5/1957 | Patterson | 34/75 |
| 2,802,283 | A | * | 8/1957 | Strike | 34/87 |
| 2,809,442 | A | * | 10/1957 | Glasby, Jr. | 34/82 |
| 2,818,719 | A | * | 1/1958 | Cline | 68/19.2 |
| 2,871,576 | A | * | 2/1959 | Ramey | 34/87 |
| 2,875,996 | A | * | 3/1959 | Hullar | 432/67 |
| 2,885,789 | A | * | 5/1959 | Conkling et al. | 34/547 |
| 2,899,816 | A | * | 8/1959 | Jacobsen, Jr. | 68/20 |
| 2,928,267 | A | * | 3/1960 | Frey et al. | 68/12.22 |
| 2,958,140 | A | * | 11/1960 | Smith | 34/598 |
| 2,958,954 | A | * | 11/1960 | Longenecker | 34/527 |
| 2,996,809 | A | * | 8/1961 | Shapter | 34/75 |
| 3,018,562 | A | * | 1/1962 | Orr | 34/75 |
| 3,034,226 | A | * | 5/1962 | Conlee | 34/596 |
| 3,036,383 | A | * | 5/1962 | Edwards | 34/76 |
| 3,050,867 | A | * | 8/1962 | Friedman | 34/86 |
| 3,061,942 | A | * | 11/1962 | Scofield | 34/82 |
| 3,066,423 | A | * | 12/1962 | Solem | 34/86 |
| 3,075,296 | A | * | 1/1963 | Stone | 34/75 |
| 3,095,284 | A | * | 6/1963 | Victor | 34/473 |
| 3,099,542 | A | * | 7/1963 | Van Scoyk | 34/554 |
| 3,113,445 | A | * | 12/1963 | Williams et al. | 68/12.08 |
| 3,155,462 | A | * | 11/1964 | Erickson et al. | 34/82 |
| 3,161,481 | A | * | 12/1964 | Edwards | 34/527 |
| 3,173,767 | A | * | 3/1965 | Perloff | 34/82 |
| 3,186,104 | A | * | 6/1965 | Stilwell, Jr. | 34/527 |
| 3,186,106 | A | * | 6/1965 | Cobb et al. | 34/527 |
| 3,270,530 | A | * | 9/1966 | Czech | 68/18 R |
| 3,273,256 | A | * | 9/1966 | Behrens | 34/546 |
| 3,285,589 | A | * | 11/1966 | Worst | 432/43 |
| 3,333,346 | A | * | 8/1967 | Brucken | 34/131 |
| 3,460,267 | A | * | 8/1969 | Lorenz | 34/533 |
| 3,508,340 | A | * | 4/1970 | Kombol | 34/553 |
| 3,555,701 | A | * | 1/1971 | Hubbard | 4/602 |
| 3,622,134 | A | * | 11/1971 | Mazza | 432/105 |
| 3,771,238 | A | * | 11/1973 | Vaughn | 34/86 |
| 3,805,404 | A | * | 4/1974 | Gould | 34/75 |
| 3,884,213 | A | * | 5/1975 | Smith | 126/21 A |
| 3,969,070 | A | * | 7/1976 | Thompson | 432/105 |
| 4,003,138 | A | * | 1/1977 | Wicks | 34/86 |
| 4,016,657 | A | * | 4/1977 | Passey | 34/92 |
| 4,035,927 | A | * | 7/1977 | Spiegel | 34/622 |
| 4,090,370 | A | * | 5/1978 | Vaughan | 62/91 |
| 4,103,433 | A | * | 8/1978 | Taylor | 34/86 |
| 4,112,590 | A | * | 9/1978 | Muller | 34/75 |
| 4,154,003 | A | * | 5/1979 | Muller | 34/469 |
| 4,154,861 | A | * | 5/1979 | Smith | 426/466 |
| 4,182,050 | A | * | 1/1980 | Righi | 34/60 |
| 4,207,056 | A | * | 6/1980 | Bowley | 432/3 |
| 4,231,166 | A | | 11/1980 | McMillan | 34/48 |
| 4,270,282 | A | * | 6/1981 | Lotz | 34/86 |
| 4,338,911 | A | * | 7/1982 | Smith | 126/21 A |
| 4,348,818 | A | * | 9/1982 | Brown | 34/77 |
| 4,360,977 | A | * | 11/1982 | Frohbieter | 34/86 |
| 4,395,831 | A | * | 8/1983 | Nielsen | 34/86 |
| 4,409,453 | A | * | 10/1983 | Smith | 219/684 |
| 4,481,786 | A | * | 11/1984 | Bashark | 62/160 |
| 4,488,364 | A | * | 12/1984 | Herschel | 34/86 |
| 4,516,335 | A | * | 5/1985 | Aoki et al. | 34/608 |
| 4,603,489 | A | * | 8/1986 | Goldberg | 34/77 |
| 4,621,438 | A | * | 11/1986 | Lanciaux | 34/77 |
| 4,669,199 | A | * | 6/1987 | Clawson et al. | 34/82 |
| 4,680,938 | A | * | 7/1987 | Caley | 62/93 |
| 4,689,896 | A | * | 9/1987 | Narang | 34/82 |
| 4,698,507 | A | * | 10/1987 | Tator et al. | 250/429 |
| 4,756,623 | A | * | 7/1988 | Bishop | 366/57 |
| 4,811,495 | A | * | 3/1989 | Huang et al. | 34/131 |
| 4,817,297 | A | * | 4/1989 | Toma et al. | 34/595 |
| 4,817,298 | A | * | 4/1989 | Toma | 34/595 |
| 4,850,119 | A | * | 7/1989 | Fuhring | 34/77 |
| 4,875,298 | A | * | 10/1989 | Wright | 34/86 |
| 4,891,892 | A | * | 1/1990 | Narang | 34/86 |
| 4,899,264 | A | * | 2/1990 | Ries et al. | 362/92 |
| 4,941,270 | A | * | 7/1990 | Hoffman | 34/60 |
| 4,974,339 | A | * | 12/1990 | Kawamura et al. | 34/73 |
| 5,016,361 | A | * | 5/1991 | Durr | 34/370 |
| 5,042,171 | A | * | 8/1991 | Obata et al. | 34/604 |
| 5,107,606 | A | * | 4/1992 | Tsubaki et al. | 34/596 |
| 5,117,563 | A | * | 6/1992 | Castonguay | 34/86 |
| 5,136,792 | A | * | 8/1992 | Janecke | 34/78 |
| 5,143,663 | A | * | 9/1992 | Leyden et al. | 264/401 |
| 5,146,693 | A | * | 9/1992 | Dottor et al. | 34/77 |
| 5,212,969 | A | * | 5/1993 | Tsubaki et al. | 68/19.2 |
| 5,279,047 | A | * | 1/1994 | Janecke | 34/78 |
| 5,284,427 | A | * | 2/1994 | Wacker | 418/83 |
| 5,337,500 | A | * | 8/1994 | Enokizono | 34/77 |
| 5,459,945 | A | * | 10/1995 | Shulenberger | 34/605 |
| 5,556,028 | A | * | 9/1996 | Khelifa | 237/12.3 A |
| 5,709,040 | A | * | 1/1998 | Horwitz | 34/565 |
| 5,709,041 | A | * | 1/1998 | Tarplee | 34/595 |
| 5,806,323 | A | * | 9/1998 | Bevier | 62/91 |
| 5,887,456 | A | * | 3/1999 | Tanigawa et al. | 68/20 |
| 5,960,563 | A | * | 10/1999 | Kuboyama | 34/589 |
| 5,983,520 | A | * | 11/1999 | Kim et al. | 34/261 |
| 5,996,247 | A | * | 12/1999 | Kuboyama | 34/370 |
| 6,001,221 | A | * | 12/1999 | Kuboyama | 202/168 |
| 6,026,588 | A | * | 2/2000 | Clark et al. | 34/77 |
| 6,032,494 | A | * | 3/2000 | Tanigawa et al. | 68/12.06 |
| 6,035,552 | A | * | 3/2000 | Kruger et al. | 34/595 |
| 6,088,932 | A | * | 7/2000 | Adamski et al. | 34/274 |
| 6,151,795 | A | * | 11/2000 | Hoffman et al. | 34/92 |
| 6,154,978 | A | * | 12/2000 | Slutsky | 34/321 |
| 6,205,805 | B1 | * | 3/2001 | Takahashi et al. | 62/271 |
| 6,334,267 | B1 | * | 1/2002 | Slutsky | 34/606 |
| 6,434,857 | B1 | * | 8/2002 | Anderson et al. | 34/595 |
| 6,618,957 | B2 | * | 9/2003 | Novak et al. | 34/264 |
| 6,665,953 | B2 | * | 12/2003 | Woo et al. | 34/527 |
| 6,722,165 | B2 | * | 4/2004 | Woo et al. | 68/19.2 |
| 6,726,914 | B2 | * | 4/2004 | Aoki | 424/400 |
| 6,769,196 | B2 | * | 8/2004 | Park et al. | 34/77 |
| 6,796,055 | B2 | * | 9/2004 | Baltes | 34/449 |
| 6,832,441 | B2 | * | 12/2004 | Jeong et al. | 34/318 |
| 6,874,248 | B2 | * | 4/2005 | Hong et al. | 34/239 |
| 6,904,703 | B2 | * | 6/2005 | Naganawa et al. | 34/596 |
| 6,931,755 | B1 | * | 8/2005 | Hsu | 34/80 |
| 6,931,756 | B2 | * | 8/2005 | Morgan et al. | 34/202 |
| 6,931,759 | B2 | * | 8/2005 | Jeong et al. | 34/485 |
| 6,941,680 | B1 | * | 9/2005 | Zielewicz et al. | 34/607 |
| 6,957,501 | B2 | * | 10/2005 | Park et al. | 34/446 |
| 6,981,336 | B2 | * | 1/2006 | Nagae et al. | 34/77 |
| 7,017,282 | B2 | * | 3/2006 | Pyo et al. | 34/596 |
| 7,020,985 | B2 | * | 4/2006 | Casey et al. | 34/595 |
| 7,021,088 | B2 | * | 4/2006 | Hong et al. | 68/20 |
| 7,024,795 | B2 | * | 4/2006 | Tadano et al. | 34/76 |
| 7,032,326 | B2 | * | 4/2006 | Hong | 34/602 |
| 7,036,243 | B2 | * | 5/2006 | Doh et al. | 34/595 |
| 7,055,262 | B2 | * | 6/2006 | Goldberg et al. | 34/86 |
| 7,065,904 | B2 | * | 6/2006 | Lee et al. | 34/601 |
| 7,069,669 | B2 | * | 7/2006 | Park et al. | 34/603 |
| 7,093,377 | B2 | * | 8/2006 | Doh et al. | 34/596 |
| 7,121,018 | B2 | * | 10/2006 | Lee | 34/595 |
| 7,162,812 | B2 | * | 1/2007 | Cimetta et al. | 34/469 |
| 7,194,823 | B2 | * | 3/2007 | Nakamoto et al. | 34/526 |
| 7,222,439 | B2 | * | 5/2007 | Paintner | 34/73 |
| 7,228,647 | B2 | * | 6/2007 | Hong | 34/596 |
| 7,275,399 | B2 | * | 10/2007 | Park et al. | 68/18 C |
| 7,302,815 | B2 | * | 12/2007 | Kim et al. | 68/18 C |
| 7,325,333 | B2 | * | 2/2008 | Tadano et al. | 34/604 |
| 7,347,009 | B2 | * | 3/2008 | Ahn et al. | 34/607 |
| 7,356,945 | B2 | * | 4/2008 | Choi et al. | 34/597 |
| 7,406,780 | B2 | * | 8/2008 | Doh et al. | 34/606 |
| 7,409,776 | B2 | * | 8/2008 | Ono et al. | 34/77 |
| 7,415,848 | B2 | * | 8/2008 | Jeong et al. | 68/18 C |
| 7,418,789 | B2 | * | 9/2008 | Choi et al. | 34/380 |
| 7,448,146 | B2 | * | 11/2008 | Cho et al. | 34/601 |
| 7,481,083 | B2 | * | 1/2009 | Habu et al. | 68/19.2 |
| 7,591,859 | B2 | * | 9/2009 | Wong et al. | 8/149.3 |
| 2002/0046474 | A1 | * | 4/2002 | Novak et al. | 34/259 |
| 2003/0051370 | A1 | * | 3/2003 | Jeong et al. | 34/318 |
| 2003/0066206 | A1 | * | 4/2003 | Woo et al. | 34/425 |

| | | | | |
|---|---|---|---|---|
| 2003/0079368 | A1* | 5/2003 | Hoffman | 34/202 |
| 2003/0097763 | A1* | 5/2003 | Morgan et al. | 34/468 |
| 2004/0010937 | A1* | 1/2004 | Naganawa et al. | 34/595 |
| 2004/0060197 | A1* | 4/2004 | Jeong et al. | 34/595 |
| 2004/0068889 | A1* | 4/2004 | Park et al. | 34/446 |
| 2004/0098878 | A1* | 5/2004 | Park et al. | 34/595 |
| 2004/0103556 | A1* | 6/2004 | Bang | 34/595 |
| 2004/0118010 | A1* | 6/2004 | Shardlow | 34/595 |
| 2004/0134092 | A1* | 7/2004 | Hong et al. | 34/595 |
| 2004/0255394 | A1* | 12/2004 | Mani et al. | 8/159 |
| 2005/0000112 | A1* | 1/2005 | Gagnon | 34/603 |
| 2005/0028400 | A1* | 2/2005 | Matteson | 34/595 |
| 2005/0044744 | A1* | 3/2005 | Tadano et al. | 34/596 |
| 2005/0050765 | A1* | 3/2005 | Park et al. | 34/603 |
| 2005/0086832 | A1* | 4/2005 | Declos | 34/604 |
| 2005/0120585 | A1* | 6/2005 | Lee et al. | 34/602 |
| 2005/0126035 | A1* | 6/2005 | Lee et al. | 34/602 |
| 2005/0132594 | A1* | 6/2005 | Doh et al. | 34/73 |
| 2005/0132601 | A1* | 6/2005 | Doh | 34/601 |
| 2005/0132604 | A1* | 6/2005 | Hong et al. | 34/603 |
| 2005/0138831 | A1* | 6/2005 | Lee | 34/73 |
| 2005/0155250 | A1* | 7/2005 | Chung et al. | 34/602 |
| 2005/0160620 | A1* | 7/2005 | Morgan et al. | 34/469 |
| 2005/0166421 | A1* | 8/2005 | Doh et al. | 34/603 |
| 2005/0198852 | A1* | 9/2005 | Ono et al. | 34/77 |
| 2005/0210698 | A1* | 9/2005 | Casey et al. | 34/134 |
| 2005/0223592 | A1* | 10/2005 | Hong | 34/601 |
| 2005/0252030 | A1* | 11/2005 | Park et al. | 34/601 |
| 2005/0252032 | A1* | 11/2005 | Park et al. | 34/604 |
| 2005/0268483 | A1* | 12/2005 | Park et al. | 34/603 |
| 2006/0096114 | A1* | 5/2006 | Hong | 34/77 |
| 2006/0112585 | A1* | 6/2006 | Choi et al. | 34/73 |
| 2006/0117593 | A1* | 6/2006 | Ahn et al. | 34/513 |
| 2006/0117595 | A1* | 6/2006 | Virzi et al. | 34/607 |
| 2006/0236560 | A1* | 10/2006 | Doh et al. | 34/596 |
| 2006/0254082 | A1* | 11/2006 | Kim | 34/595 |
| 2007/0113421 | A1* | 5/2007 | Uhara et al. | 34/275 |
| 2007/0175063 | A1* | 8/2007 | Morgan et al. | 34/467 |
| 2007/0199207 | A1* | 8/2007 | Oh et al. | 34/602 |
| 2007/0227035 | A1* | 10/2007 | Leroy | 34/602 |
| 2007/0266587 | A1* | 11/2007 | Bringewatt et al. | 34/134 |
| 2008/0000098 | A1* | 1/2008 | Choi et al. | 34/114 |
| 2008/0034607 | A1* | 2/2008 | Ahn et al. | 34/130 |
| 2008/0034608 | A1* | 2/2008 | Ahn et al. | 34/134 |
| 2008/0141550 | A1* | 6/2008 | Bae et al. | 34/68 |
| 2008/0141552 | A1* | 6/2008 | Bae et al. | 34/108 |
| 2008/0141554 | A1* | 6/2008 | Bae et al. | 34/132 |
| 2008/0141557 | A1* | 6/2008 | Son et al. | 34/565 |
| 2008/0141558 | A1* | 6/2008 | Bae et al. | 34/595 |
| 2008/0141734 | A1* | 6/2008 | Son et al. | 68/5 C |
| 2008/0168679 | A1* | 7/2008 | Son et al. | 34/497 |
| 2008/0196268 | A1* | 8/2008 | Jung et al. | 34/603 |
| 2008/0307667 | A1* | 12/2008 | Ikemizu | 34/132 |
| 2008/0313922 | A1* | 12/2008 | Bae et al. | 34/491 |
| 2009/0025407 | A1* | 1/2009 | Dalla Valle et al. | 62/129 |
| 2009/0056161 | A1* | 3/2009 | Ahn et al. | 34/79 |
| 2009/0071033 | A1* | 3/2009 | Ahn et al. | 34/595 |
| 2009/0113745 | A1* | 5/2009 | Choi et al. | 34/139 |
| 2009/0113755 | A1* | 5/2009 | Choi et al. | 34/390 |
| 2009/0126222 | A1* | 5/2009 | Bae et al. | 34/527 |
| 2009/0133281 | A1* | 5/2009 | Yoon et al. | 34/72 |
| 2009/0172967 | A1* | 7/2009 | Son et al. | 34/318 |
| 2009/0211109 | A1* | 8/2009 | Choi et al. | 34/491 |

FOREIGN PATENT DOCUMENTS

| | | | | |
|---|---|---|---|---|
| DE | 31 48 573 | A1 | | 6/1983 |
| DE | 35 43 722 | A1 | | 10/1987 |
| DE | 3710710 | A1 | * | 10/1988 |
| DE | 4304226 | A1 | * | 8/1994 |
| DE | 19906061 | A1 | * | 8/2000 |
| DE | 10 2005 015 653 | | | 10/2006 |
| EP | 49170 | A2 | * | 4/1982 |
| EP | 0 250 870 | A2 | | 1/1988 |
| EP | 503586 | A1 | * | 9/1992 |
| EP | 505116 | A2 | * | 9/1992 |
| EP | 0 552 843 | B1 | | 4/1996 |
| GB | 2052704 | A | * | 1/1981 |
| GB | 2174792 | A | * | 11/1986 |
| GB | 2237372 | A | * | 5/1991 |
| GB | 2237373 | A | * | 5/1991 |
| GB | 2242261 | A | * | 9/1991 |
| GB | 2261060 | A | * | 5/1993 |
| GB | 2 289 752 | A | | 11/1995 |
| GB | 2 375 812 | A | | 11/2002 |
| JP | 54084655 | A | * | 7/1979 |
| JP | 54104074 | A | * | 8/1979 |
| JP | 54106960 | A | * | 8/1979 |
| JP | 54108060 | A | * | 8/1979 |
| JP | 54133670 | A | * | 10/1979 |
| JP | 54137162 | A | * | 10/1979 |
| JP | 55056519 | A | * | 4/1980 |
| JP | 55149633 | A | * | 11/1980 |
| JP | 56133549 | A | * | 10/1981 |
| JP | 57115138 | A | * | 7/1982 |
| JP | 57189048 | A | * | 11/1982 |
| JP | 59032710 | A | * | 2/1984 |
| JP | 60080044 | A | * | 5/1985 |
| JP | 60243485 | A | * | 12/1985 |
| JP | 61053475 | A | * | 3/1986 |
| JP | 61149750 | A | * | 7/1986 |
| JP | 61212313 | A | * | 9/1986 |
| JP | 61291020 | A | * | 12/1986 |
| JP | 62066033 | A | * | 3/1987 |
| JP | 63080829 | A | * | 4/1988 |
| JP | 01005598 | A | * | 1/1989 |
| JP | 01027599 | A | * | 1/1989 |
| JP | 01032897 | A | * | 2/1989 |
| JP | 01107798 | A | * | 4/1989 |
| JP | 01135394 | A | * | 5/1989 |
| JP | 01141690 | A | * | 6/1989 |
| JP | 01145097 | A | * | 6/1989 |
| JP | 01151495 | A | * | 6/1989 |
| JP | 01175896 | A | * | 7/1989 |
| JP | 01175897 | A | * | 7/1989 |
| JP | 01178299 | A | * | 7/1989 |
| JP | 01204698 | A | * | 8/1989 |
| JP | 01218499 | A | * | 8/1989 |
| JP | 01242097 | A | * | 9/1989 |
| JP | 01266000 | A | * | 10/1989 |
| JP | 02046896 | A | * | 2/1990 |
| JP | 02057300 | A | * | 2/1990 |
| JP | 02071069 | A | * | 3/1990 |
| JP | 02071798 | A | * | 3/1990 |
| JP | 02077298 | A | * | 3/1990 |
| JP | 02092399 | A | * | 4/1990 |
| JP | 02109598 | A | * | 4/1990 |
| JP | 02116399 | A | * | 5/1990 |
| JP | 02121697 | A | * | 5/1990 |
| JP | 02128799 | A | * | 5/1990 |
| JP | 02142596 | A | * | 5/1990 |
| JP | 02156986 | A | * | 6/1990 |
| JP | 02162000 | A | * | 6/1990 |
| JP | 02174897 | A | * | 7/1990 |
| JP | 02223712 | A | * | 9/1990 |
| JP | 03128069 | A | * | 5/1991 |
| JP | 03155898 | A | * | 7/1991 |
| JP | 03156251 | A | * | 7/1991 |
| JP | 03168119 | A | * | 7/1991 |
| JP | 03260564 | A | * | 11/1991 |
| JP | 04006359 | A | * | 1/1992 |
| JP | 04035695 | A | * | 2/1992 |
| JP | 04099596 | A | * | 3/1992 |
| JP | 04099598 | A | * | 3/1992 |
| JP | 04099599 | A | * | 3/1992 |
| JP | 04122390 | A | * | 4/1992 |
| JP | 04126196 | A | * | 4/1992 |
| JP | 04141197 | A | * | 5/1992 |
| JP | 04-197298 | | | 7/1992 |
| JP | 04187138 | A | * | 7/1992 |
| JP | 04189398 | A | * | 7/1992 |
| JP | 04200500 | A | * | 7/1992 |
| JP | 04240497 | A | * | 8/1992 |
| JP | 04253897 | A | * | 9/1992 |
| JP | 04276300 | A | * | 10/1992 |
| JP | 04284451 | A | * | 10/1992 |
| JP | 04338495 | A | * | 11/1992 |
| JP | 05042094 | A | * | 2/1993 |
| JP | 05115691 | A | * | 5/1993 |

| | | | | |
|---|---|---|---|---|
| JP | 05115693 | A | * | 5/1993 |
| JP | 05130950 | A | * | 5/1993 |
| JP | 05154292 | A | * | 6/1993 |
| JP | 05245297 | A | * | 9/1993 |
| JP | 05329298 | A | * | 12/1993 |
| JP | 05337292 | A | * | 12/1993 |
| JP | 06000290 | A | * | 1/1994 |
| JP | 06000291 | A | * | 1/1994 |
| JP | 06000292 | A | * | 1/1994 |
| JP | 06000293 | A | * | 1/1994 |
| JP | 06039194 | A | * | 2/1994 |
| JP | 06063295 | A | * | 3/1994 |
| JP | 06086898 | A | * | 3/1994 |
| JP | 06134187 | A | * | 5/1994 |
| JP | 06134191 | A | * | 5/1994 |
| JP | 06134192 | A | * | 5/1994 |
| JP | 06134193 | A | * | 5/1994 |
| JP | 06134194 | A | * | 5/1994 |
| JP | 06137712 | A | * | 5/1994 |
| JP | 06154489 | A | * | 6/1994 |
| JP | 06170091 | A | * | 6/1994 |
| JP | 06170092 | A | * | 6/1994 |
| JP | 06170095 | A | * | 6/1994 |
| JP | 06190193 | A | * | 7/1994 |
| JP | 06190196 | A | * | 7/1994 |
| JP | 06218197 | A | * | 8/1994 |
| JP | 06281264 | A | * | 10/1994 |
| JP | 07189980 | A | * | 7/1995 |
| JP | 07299295 | A | * | 11/1995 |
| JP | 07328291 | A | * | 12/1995 |
| JP | 08024497 | A | * | 1/1996 |
| JP | 08166187 | A | * | 6/1996 |
| JP | 08182892 | A | * | 7/1996 |
| JP | 08182893 | A | * | 7/1996 |
| JP | 08182895 | A | * | 7/1996 |
| JP | 08296962 | A | * | 11/1996 |
| JP | 08332300 | A | * | 12/1996 |
| JP | 09010495 | A | * | 1/1997 |
| JP | 09010496 | A | * | 1/1997 |
| JP | 09026192 | A | * | 1/1997 |
| JP | 09028997 | A | * | 2/1997 |
| JP | 09028998 | A | * | 2/1997 |
| JP | 09038391 | A | * | 2/1997 |
| JP | 09117746 | A | * | 5/1997 |
| JP | 09276599 | A | * | 10/1997 |
| JP | 09285696 | A | * | 11/1997 |
| JP | 10033896 | A | * | 2/1998 |
| JP | 10216398 | A | * | 8/1998 |
| JP | 10225599 | A | * | 8/1998 |
| JP | 10249098 | A | * | 9/1998 |
| JP | 10325678 | A | * | 12/1998 |
| JP | 11107349 | A | * | 4/1999 |
| JP | 11128155 | A | * | 5/1999 |
| JP | 11248230 | A | * | 9/1999 |
| JP | 11304226 | A | * | 11/1999 |
| JP | 11319396 | A | * | 11/1999 |
| JP | 11325637 | A | * | 11/1999 |
| JP | 11342299 | A | * | 12/1999 |
| JP | 2000157796 | A | * | 6/2000 |
| JP | 2000167299 | A | * | 6/2000 |
| JP | 2000237500 | A | * | 9/2000 |
| JP | 2000266387 | A | * | 9/2000 |
| JP | 2000292013 | A | * | 10/2000 |
| JP | 2000356468 | A | * | 12/2000 |
| JP | 2001000795 | A | * | 1/2001 |
| JP | 2002071191 | A | * | 3/2002 |
| JP | 2002102580 | A | * | 4/2002 |
| JP | 2002166091 | A | * | 6/2002 |
| JP | 2002239294 | A | * | 8/2002 |
| JP | 2002346273 | A | * | 12/2002 |
| JP | 2003010583 | A | * | 1/2003 |
| JP | 2003139343 | A | * | 5/2003 |
| JP | 2004344238 | A | * | 12/2004 |
| JP | 2005265256 | A | * | 9/2005 |
| JP | 2005291654 | A | * | 10/2005 |
| JP | 2006010267 | A | * | 1/2006 |
| KR | 10-2000-0003228 | A | | 1/2000 |
| KR | 10-442401 | B1 | | 7/2004 |
| WO | WO 2007022604 | A1 | * | 3/2007 |

* cited by examiner

CLOTHES DRYER

TECHNICAL FIELD

The present invention relates to a clothes dryer, and more particularly, to a clothes dryer of exhaust type including a vapor compression cycle system. The clothes dryer improves drying efficiency by drying laundry by supplying heat to an introduced air from a heat exchange cycle system.

BACKGROUND ART

Clothes dryers are mainly used to dry clothes by removing moisture from clothes that have just been washed.

The clothes dryers can be classified into an exhaust type and a condensation type according to a processing method of moist air generated while drying laundry. The former type employs a method of exhausting moist air from a dryer, while the latter employs a method of removing moisture by condensing moist air exhausted from a dryer and circulating the moisture-removed air again in the dryer.

Typically, in the exhaust type dryer, an air intake duct and an air exhaust duct are connected to a rotatable drum disposed inside a cabinet, the air intake duct having a heater disposed therein.

As air outside the dryer is introduced into the air intake duct by driving a fan, the air is heated to a high temperature by a heater. The heating temperature reaches up to about 100° C. This high temperature air is introduced into a drying drum in the dryer, thus drying laundry in the drum. In the drying procedure, the high temperature air gets to contain the moisture included in the laundry, and high humidity air is discharged through the air exhaust duct. Although such a conventional clothes dryer that delivers heat to an introduced air by using a heater has a merit that the overall drying time is shortened by the heater's rapid heating of air and it can be manufactured to have a large capacity, it has a drawback that the energy consumption is large because an introduced air is heated by the heater. Especially, there is a great probability that damages may occur depending on the material of laundry in the drying procedure since the laundry is dried with air of high temperature of 100° C. or higher.

Meanwhile, the condensation type clothes dryer has a merit that it can be manufactured in a built-in type since it requires no air exhaust duct for discharging air out of the clothes dryer, while it has a drawback that it requires a long drying time and is difficult to be manufactured to have a large capacity although its energy efficiency is higher than the exhaust type. Under this background, there is a demand for a clothes dryer that provides a high energy efficiency and is so improved that it may not cause a damage to laundry.

Meanwhile, in areas with a high humidity, for example, near seashores or areas with a long rain season, there is a problem in that the drying efficiency is relatively lower when the clothes dryer is used. This is because a large amount of moisture is contained in the air used to dry laundry. It requires a lot of time to dry laundry since the air containing a large amount of moisture is introduced into the drying drum with the moisture not being removed enough even if the air is increased in temperature by the heater, resultantly increasing the energy consumption required to complete the drying. Subsequently, there is a demand for a clothes dryer for supplying air to a drying drum with moisture removed enough from an introduced air.

DISCLOSURE OF THE INVENTION

Therefore, an object of the present invention is to provide a clothes dryer which improves energy efficiency and has little possibility of causing a damage to laundry due to a high temperature air in a drying procedure.

Another object of the present invention is to provide a clothes dryer which can introduce air to a drying drum with moisture removed enough from the introduced air.

Still another object of the present invention is to provide a clothes dryer which is compact with improved space utilization.

To achieve the above objects, according to a first aspect of the present invention, there is provided a clothes dryer, comprising: a cabinet; a drying container rotationally mounted in the cabinet; a driving portion for supplying a torque to the drying container; a first air path connected to one side of the drying container; a second air path connected to the other side of the drying container and connected to outside of the cabinet; and first and second heat exchange portions for exchanging heat with air introduced into the first air path.

Preferably, the first air path and the second air path are located below the drying container, and the first heat exchange portion is located in front of the second heat exchange portion on the first air path.

The cabinet is provided at the front face with an opening for putting laundry in and out of the drying container.

A fan for creating an air flow is disposed at least one of the first and second air paths. Preferably, the fan receives a torque from the driving portion.

According to a second aspect of the present invention, there is provided comprising: a cabinet; a drying container rotationally mounted in the cabinet; a driving portion for supplying a torque to the drying container; a first air path connected to one side of the drying container; a second air path connected to the other side of the drying container and connected to outside of the cabinet; and first and second heat exchange portions for exchanging heat with air introduced into the first air path, wherein the second air path has a damper for opening and closing the paths disposed thereon.

A temperature sensor or humidity sensor is disposed in front of the damper on the second air path. The damper is controlled in at least two states including an opened state and a closed state according to a predetermined value of a signal sensed by the temperature sensor or humidity sensor.

According to a second aspect of the present invention, there is provided comprising: a cabinet; a drying container rotationally mounted in the cabinet; a driving portion for supplying a torque to the drying container; a first air path connected to one side of the drying container; a second air path connected to the other side of the drying container and connected to outside of the cabinet; and first and second heat exchange portions for exchanging heat with air introduced into the first air path, wherein an auxiliary air inlet is formed on the first air path.

Preferably, the auxiliary air inlet is formed between the first heat exchange portion and the second heat exchange portion.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Hereinafter, preferred embodiments of the present invention will be described in more detail with reference to the accompanying drawings.

While the invention has been described in connection with preferred embodiments, it is not intended to limit the scope of the invention to the particular form set forth, but on the contrary, it is intended to cover such alternatives, modifications, and equivalents as may be included within the spirit and scope of the invention as defined by the appended claims.

Figure 1:
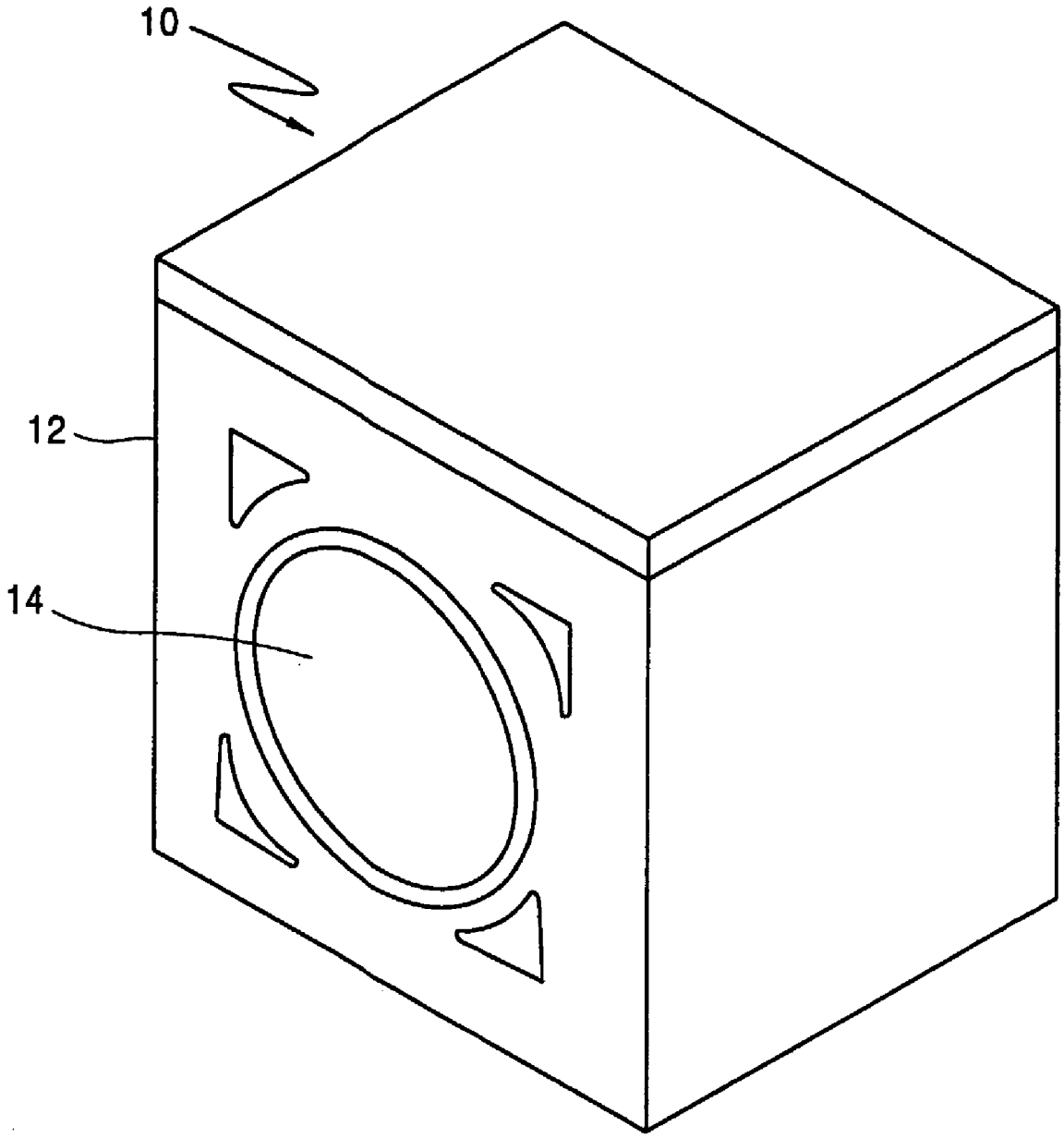
FIG. 1 is a perspective view showing the outer appearance of a clothes dryer.

First, referring to FIG. 1, one example of a clothes dryer 10 according to the present invention is illustrated. A cabinet 12 provided with an entrance 14 in the front face is hollow inside, with a drying container rotationally mounted therein.

Figure 2:
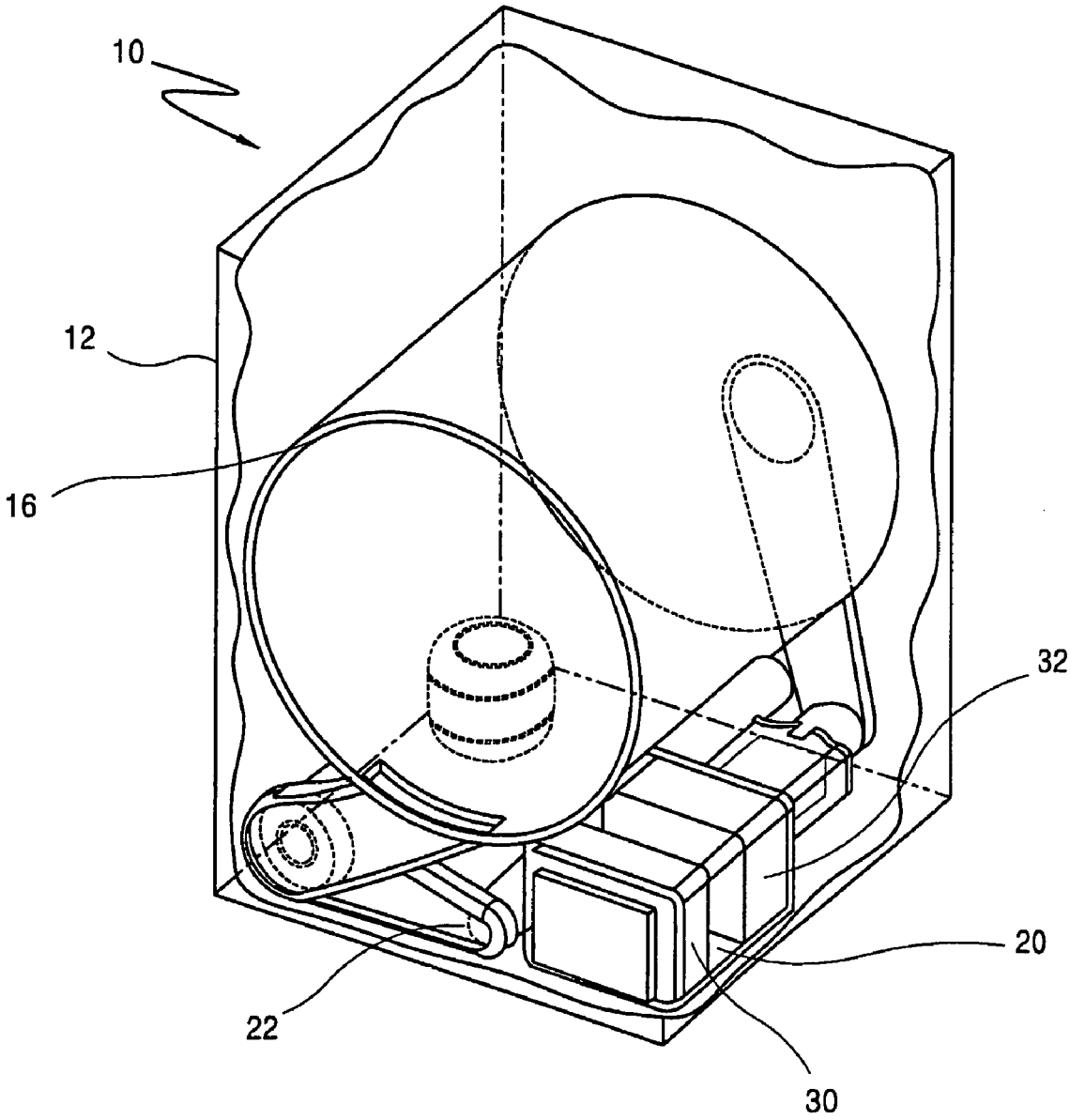
FIG. 2 is a perspective view showing the inside of a clothes dryer according to one embodiment of the present invention.
Figure 3:
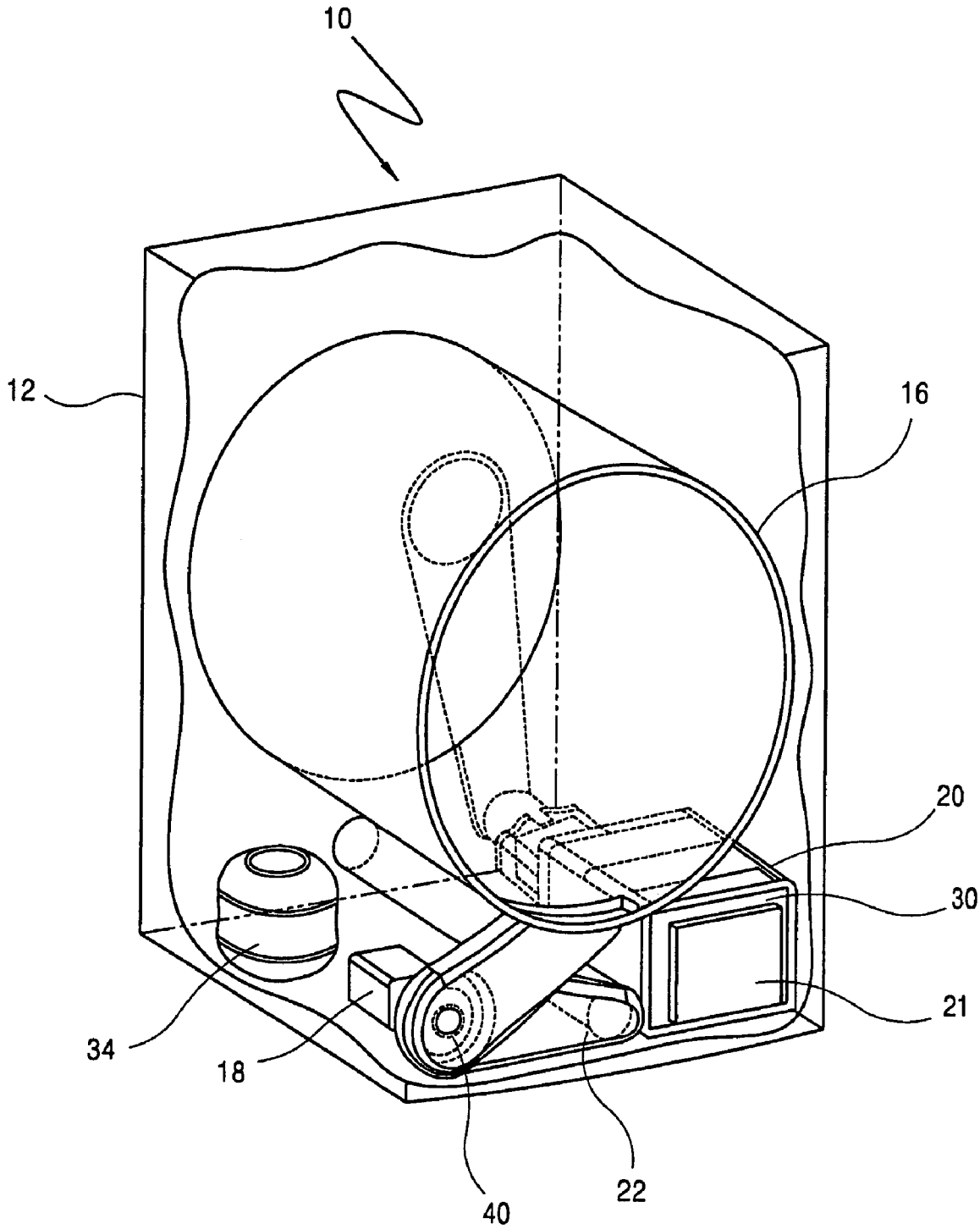
FIG. 3 is a perspective view showing the inside of a clothes dryer according to one embodiment of the present invention.

FIGS. 2 and 3 illustrates an inner structure of the clothes dryer in more detail.

The drying container 16 is a cylindrical-shaped structure, and disposed so as to rotate around an axis substantially parallel to the bottom of the cabinet 12.

The drying container 16 is made rotatable by receiving a torque from a driving portion 18, e.g., a motor, disposed on a lower side thereof, preferably, on the bottom of the cabinet 12. Typically, as a torque transmission means, a belt engaged by being extended from a driving shaft of the driving portion 18 to the outer peripheral surface of the drying container 16 is suitable. As described later, the driving portion is also able to transmit a torque to a fan 40 disposed inside the cabinet 12 and creating an air flow.

Figure 4:
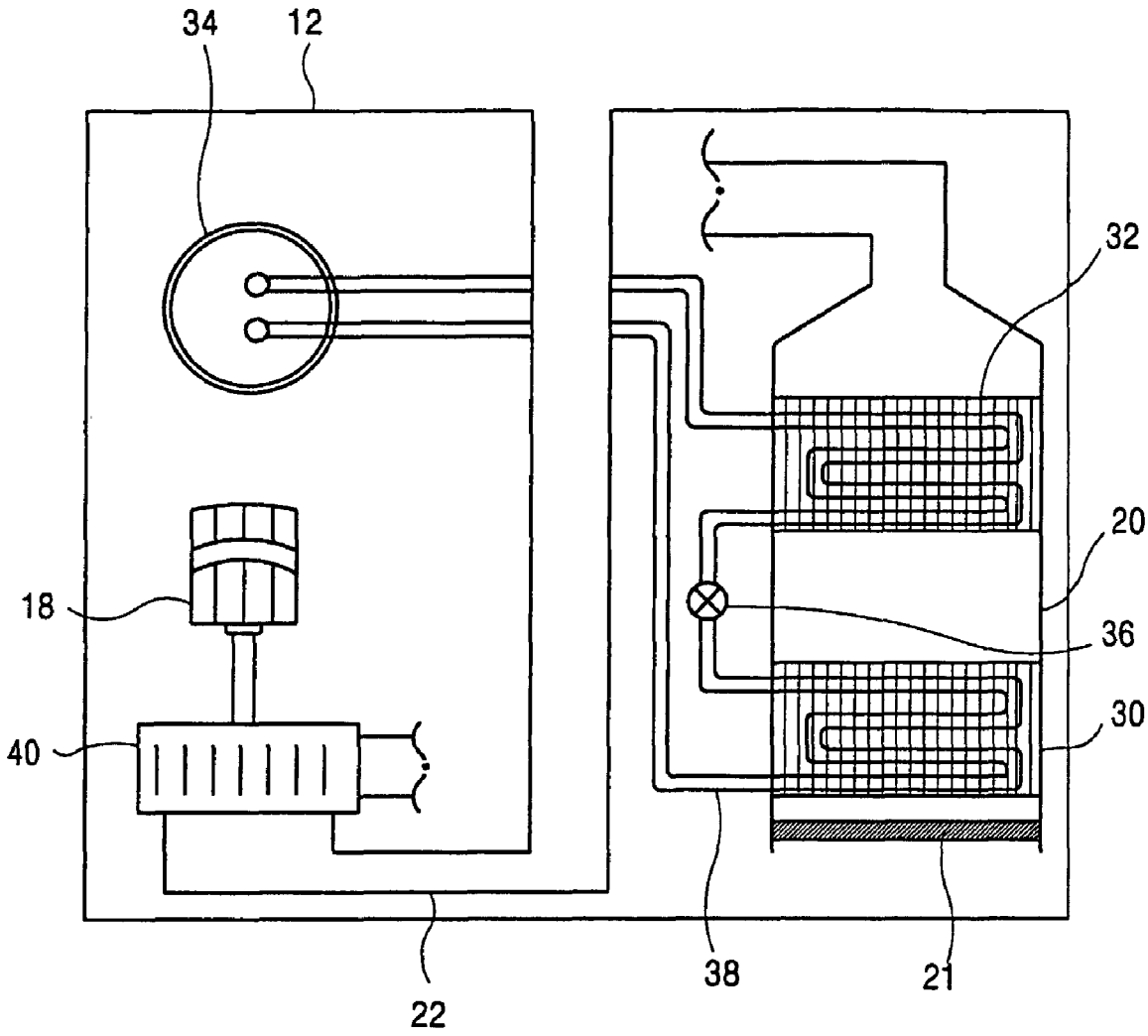
FIG. 4 is a plan view showing parts disposed on the bottom of the clothes dryer of FIG. 2.

FIG. 4 illustrates various elements disposed on the bottom of the cabinet of the clothes dryer. As illustrated in FIGS. 2 to 4, a first air channel 20 through which intake air flows is connected to at one side of the drying container 16, and a second air path 22 through which exhaust air from the drying container flows is connected to the other side thereof. It does not matter if the entrance of the first air path 20 is not exposed out of the cabinet 12, but it is preferable that the outlet of the second air path 22 is exposed out of the cabinet 12. the shapes of the first air path 20 and second air path 22 are not specifically restricted, but the direction or position of each part of the paths may be changed so as to be suitable to the space in the cabinet.

A first heat exchange portion 30 and a second heat exchange portion 32 are disposed in the first air path 20. The heat exchange portions 30 and 32 remove moisture by removing heat from the air flowing into the first air path 20, and increases the temperature of the air by applying heat. Thus, the air passing through the first air path 20 enters the drying container 16 in a dried and temperature-increased state.

It is preferable that the first heat exchange portion 30 and the second heat exchange portion 32 form a thermodynamic cycle. For this, the cabinet 12 further includes a compressor 34 and an expansion device 36 are preferably disposed in the lower side of the drying container or lower than the drying container. The first heat exchange portion 30 and the second heat exchange portion 32 are connected by a pipe 38 to form one closed loop. Such a cycle is a kind of "vapor compression cycle", and serves as a heat pump with respect to air flowing through the first air channel 30.

Figure 5:
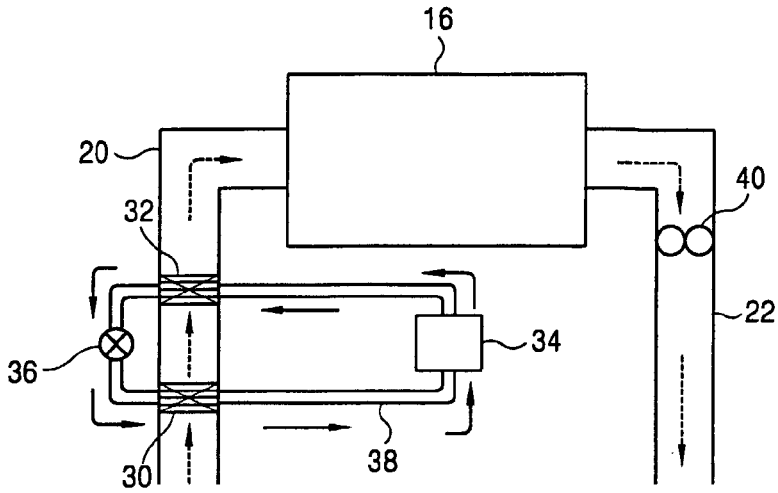
FIG. 5 is a schematic view showing a refrigerant flow and an air flow in the clothes dryer according to the present invention.

FIG. 5 schematically illustrates a refrigerant flow and an air flow in the aforementioned cycle. A proper refrigerant flows in the pipe 38 for connecting each of the elements of the cycle. As for the direction thereof, the refrigerant proceeds to the first heat exchange portion 30 from the second heat exchange portion 32 through the expansion device 36, and then proceeds to the second heat exchange portion 32 from the first heat exchange portion 30 through the compressor 34. This flow direction of the refrigerant is indicated by a dotted arrow.

The air flowing into the first air path 20 passes through the two heat exchange portions 30 and 32 and enters the drying container 16, and then is exhausted via the second air path 22. This flow direction is indicated by a dotted arrow.

It is preferable that the air entering the first air path 20 enters the drying container in a dried state after it is increased in temperature by firstly having its moisture removed in the first heat exchange portion 30 and then receiving heat from the second heat exchange portion 32. Therefore, it is preferable that an evaporator for absorbing heat from a flowing air is used is used as the first heat exchange portion 30, a condenser for supplying heat to a flowing air is used as the second heat exchange portion 32, and the first heat exchange portion is disposed more forward than the second heat exchange portion is.

A plurality of heat exchange pins are generally mounted at the heat exchange portions 30 and 32 in order to increase a heat transfer area on the pipe through which refrigerant passes. A flowing air firstly delivers heat to the evaporator to remove its moisture while evaporating the refrigerant, and then receives heat from the condenser to be increased to a temperature higher than about 50° C., preferably, 50 to 75° C.

Preferably, each of the elements constituting the above cycle, that is, the first heat exchange portion 30, the second heat exchange portion 32, the compressor 34, the expansion device, and the pipe 38 connecting them are all disposed inside the cabinet 12, especially, below the drying container 16. For this, it is appropriate that at least some parts of the first air path, where the first heat exchange portion 30 and the second heat exchange portion 32 are disposed, are disposed below the drying container 16, and at least some parts of the second air path 22 are disposed below the drying container 16 too.

By this arrangement, there is no need to increase the volume of the cabinet, thus the inner space can be utilized efficiently, resultantly making the clothes dryer compact. If the aforementioned elements are exposed out of the clothes dryer or the volume of the cabinet is increased, the installation area of the clothes dryer in a building becomes larger, thereby decreasing the spatial utilization.

Figure 6:
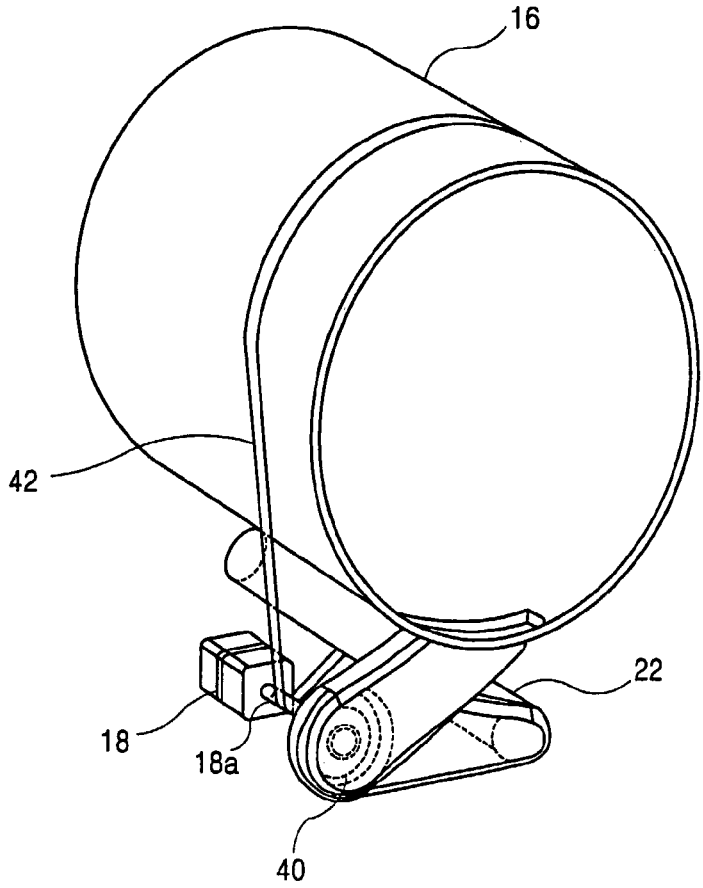
FIG. 6 is a perspective view showing some parts of the inside of the clothes dryer according to the present invention.

FIG. 6 illustrates some parts of the clothes dryer according to the present invention. As illustrated therein, a belt 42 is wound around the outer peripheral surface of the drying container 16, and the belt 42 is connected to a rotary shaft 18*a* of the driving portion 18 and transfers a torque to the drying container 16. The driving portion 18 is also connected to a fan 40 disposed on the second air path 22 to drive the fan. Thus, the driving portion 18 can rotate the drying container 16 and the fan 40 simultaneously. As above, the drying container 16 and the fan 40 are driven at a time only by the one driving portion 18, so that the space utilization in the cabinet can be increased and no additional apparatus is required, which is advantageous. Although, in FIG. 6, the fan 40 is disposed in the second air path 22 near the drying container 16, it may also be disposed on the first air path only if it can be supplied with a torque from the driving portion 18.

Meanwhile, a filter (21 of FIG. 3) is disposed on the first air path 20 before the first heat exchange portion is disposed, so that it may remove contaminants, such as dusts, contained in an introduced air in advance.

A drying process of the clothes dryer of the present invention having this construction will be described below.

When the fan 40 is driven by the rotation of the driving portion 18, a suction force is generated to introduce external air to the entrance of the first air path 20. As the introduced air passes through the first heat exchange portion 30, the moisture contained in the air is removed through a first heat exchange. The air changed to a low temperature and low humidity while passing through the first heat exchange portion 32 undergoes a secondary heat exchange while passing the second heat exchange portion 32 of a high temperature. The air changed to a high temperature and low humidity continuously passes through the inside of the first air path 20 and reaches to one side of the drying container 16.

The air having passed through the second heat exchange 32 maintains a temperature of about 50 to 75° C. The high temperature air maintaining this degree of temperature can smoothly perform drying without damaging laundry in the drying container 16.

The high temperature and low humidity introduced into the drying container 16 delivers heat while in contact with laundry containing moisture, and receives moisture from laundry and comes out of the drying container in the form of a high humidity air. The high humidity air flown out of the drying container is exhausted out of the cabinet 12 through the second air path 22.

In the clothes dryer according to the present invention, a heat generating system using a vapor compression cycle exhibits heating performance two or three times larger as compared to a heater type, under the assumption that the same power is used. Thus, power consumption can be reduced.

Further, the temperature of air introduced into the drying container is lower as compared to drying using a heater type, which causes less damage of laundry.

Besides, the first heat exchange portion of the heat generating system removes moisture from the air introduced into the first air path, thus dries laundry with low humidity air. Therefore, the drying efficiency is improved. Especially, the clothes dryer of this invention is effective to dry clothes in humid areas.

If the clothes dryer is used in dry areas, no moisture removal process accompanied by a heat exchange in the first heat exchange portion would be required. Further, since the temperature of air becomes lower in the moisture removal process, the efficiency of the overall system may be degraded. Thus, there is a need to make the second heat exchange portion and the air directly contact with each other without undergoing the heat exchange in the first heat exchange portion.

Figure 7:
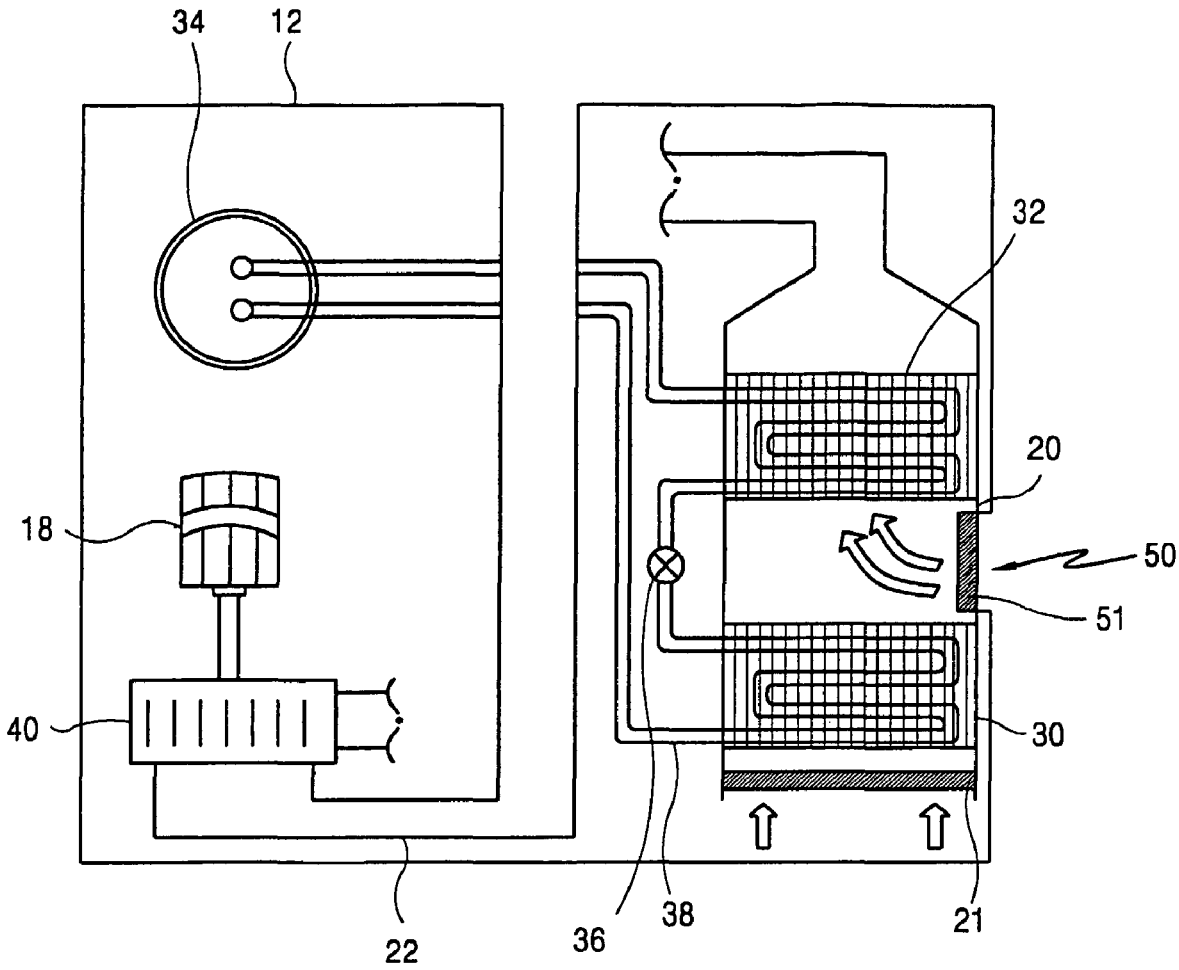
FIG. 7 is a plan view showing an air flow introduced into the clothes dryer.

FIG. 7 illustrates a clothes dryer of a modified structure according to another embodiment of the present invention. Air is introduced into a filter 21 disposed at the entrance side of the first air path 20. Further, an auxiliary air inlet 50 is formed at a side of the first air path. The auxiliary air inlet 50 may be exposed out of the cabinet 12 as shown in the drawing, or may not be exposed. The auxiliary air inlet 50 is preferably formed at a side of the first air path between the first heat exchange portion 30 and the second heat exchange portion 32. A filter 51 for removing dusts contained in external air may be disposed on the auxiliary air inlet 50.

By forming the auxiliary air inlet 50, the first air path 20 has two air inlets. The air supplied to the drying container 16 via the first air path contains the air passing through the first heat exchange portion 30 and the air directly passing though the heat exchange portion 32 without passing through the first heat exchange portion. The air introduced via the auxiliary air inlet 50 and only passing through the second heat exchange portion 32 has no heat loss caused by heat exchange with the first heat exchange portion 30, thus it can be introduced into the drying container 16 in a relatively high temperature state.

As above, by varying the air inlets of the first air path, the air supplied to the drying container can obtain a dual effect of heat loss reduction and moisture removal. Further, the overall efficiency of the vapor compression cycle system can be improved.

Hereinafter, a clothes dryer according to a second aspect of the present invention will be described.

An exhaust type dryer injects high temperature air to one side of a drying container, and discharges humid air to the other side thereof. Such a process is always the same from an initial stage of drying until an end stage of drying. If high temperature air stays in the drying container for a while and then is directly discharged out of the drying drum, this is not efficient in terms of energy utilization. That is, energy consumption is increased in the overall drying process.

In the present invention, the energy efficiency is increased by controlling an air flow such that the time during which air stays in the drying container may differ depending on a drying procedure. In a preferred embodiment, a damper for opening and closing the paths is disposed on the second air path through which air is discharged to thus control an air flow.

Figure 8:
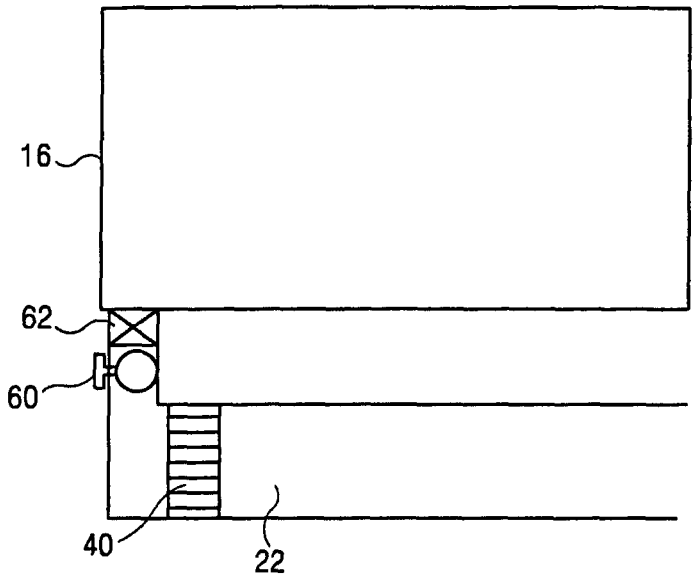
FIG. 8 is a schematic view showing some parts of the clothes dryer provided with a damper.

FIG. 8 schematically illustrates some parts of the clothes dryer with a damper disposed thereto.

A damper 60 is disposed near the drying container 16 on the second air path 22.

A sensor 63 for sensing a temperature or humidity of air discharged from the drying container 16 is disposed in front of the damper 60. The damper 60 is controlled according to a temperature or humidity sensed by the sensor 62, thereby adjusting the flow of air passing through the second air path 22.

A method of controlling the opening and closing of the damper can be selected variously according to a dried state of laundry or a state of the air discharged from the drying container.

Figure 9:
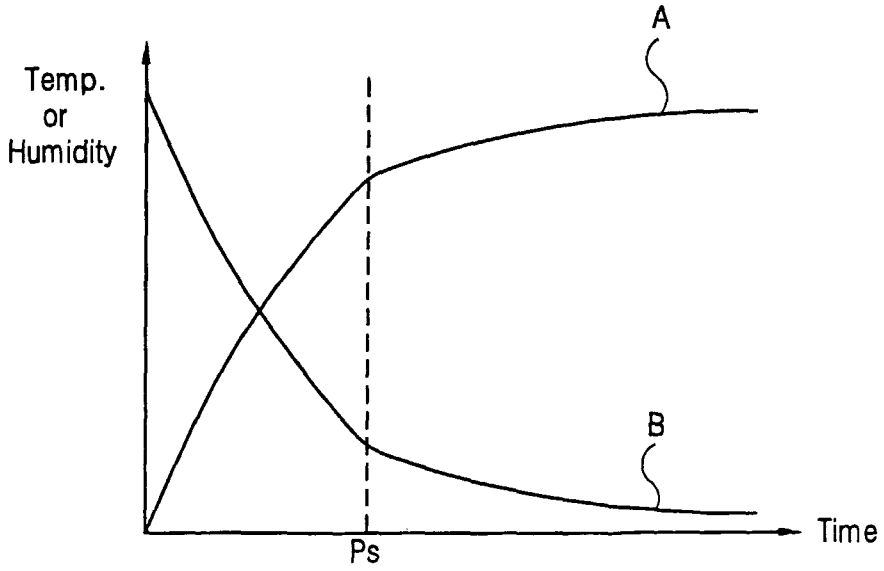
FIG. 9 is a graph showing a rate of change in temperature (or humidity) in the drying container.

Referring to FIG. 9, a rate of change per time in temperature (A) or humidity (B) of air discharged from the drying container is shown. A degree of opening and closing the damper may be changed based on a saturation point Ps at which an increase rate of temperature sensed by the sensor becomes lower or a decrease rate of humidity becomes slow.

For example, it is possible to control the damper to be closed if a measured temperature of an air outlet portion of the drying container is less than a predetermined temperature (i.e., 60° C.) or control the damper to be opened if it is greater than the predetermined temperature. Besides, it is also possible to close the damper until a measured humidity of air discharged from the air outlet portion of the drying container reaches a predetermined value and open the damper if it exceeds the predetermined value.

By this method, the damper is closed in an initial stage of drying to increase the time during which a high temperature air stays in the drying container, and the damper is opened in an intermediate or end stage of drying to increase a discharge amount of air. Therefore, there is a lot of time for which high temperature air is contacted with laundry in the initial stage of drying, thus even a small air flow can be efficiently utilized for drying. Further, in the intermediate or end stage of drying, the energy consumption can be reduced by decreasing an air heating degree rather than by increasing an air flow amount.

Meanwhile, if the damper is fully opened for a long time, the pressure in the drying container may be excessively increased or a large load may be applied to the fan for creating an air flow. To prevent this, the step of partially opening the damper may be included.

That is, a multistage damper control method may be used in which the damper is fully opened if a measured pressure in the drying container reaches a predetermined pressure or if a temperature or humidity reaches a predetermined value after the damper is slightly opened in advance when the temperature or humidity reaches a given value before the air outlet in the drying container reaches the predetermined temperature or humidity.

As described above, the present invention can properly control a humidity and temperature of air introduced to the drying container by including first and second heat exchange portions serving as heat pumps.

Furthermore, if the vapor compression cycle system is disposed below the drying container as in the present invention, the internal structure of the dryer is utilized as its, and thus there is no need for volume increase. That is, the space required to dispose the system gets smaller as compared to the case where the system is disposed at a side or rear of the cabinet.

Besides, the present invention can control an air path resistance by changing the degree of opening and closing the damper disposed between the drying container and the air path. When the air path resistance is increased, the time for which high temperature air stays in the drying drum can be lengthened, thereby removing a lot of moisture from laundry. Consequently, the energy consumption of the dryer can be reduced.

The invention claimed is:

1. A clothes dryer, comprising:

a cabinet;

a drying container rotationally mounted in the cabinet;

a motor providing the container with rotational force;

a first air path connected to a side of the container;

a second air path connected to another side of the container and to the outside of the cabinet;

a first heat exchanger to remove heat and moister from air flowing along the first air path;

a second heat exchanger to increase a temperature of air exiting the first heat exchanger, the air exiting the second heat exchanger flowing into the container; and an auxiliary air inlet to provide a flow of air at a location between the first heat exchanger and the second heat exchanger, wherein the air from the auxiliary air inlet is combined with the air exiting the first heat exchanger and the combined air is heated by the second heat exchanger for input into the container.

2. The clothes dryer of claim 1, wherein the first air path and the second air path are on the lower part of the cabinet.

3. The clothes dryer of claim 1, wherein a filter is placed in the auxiliary air inlet.

4. The clothes dryer of claim 1, further comprising:

a damper to control air flow along the second air path, wherein the damper is changed between an open state and closed state to achieve a desired relationship relative to a predetermined saturation point, the damper changing between the open and closed states based on a signal from at least one of a temperature sensor and a humidity sensor disposed along the second air path.

5. The clothes dryer of claim 4, where the desired relationship relative to the predetermined saturation point corresponds to a predetermined temperature and a predetermined humidity for the air flowing along the second air path or for air to the input into the drum through the first and second heat exchangers.

* * * * *